United States Patent [19]

Vives et al.

[11] Patent Number: 4,723,591

[45] Date of Patent: Feb. 9, 1988

[54] APPARATUS FOR REGULATING THE LEVEL OF THE LINE OF CONTACT OF THE FREE SURFACE OF THE METAL WITH THE INGOT MOULD IN A VERTICAL CASTING OPERATION

[75] Inventors: Charles Vives, Chateaurenard; Jean-Pierre Riquet, St. Geoirs, both of France

[73] Assignee: Cegedur Societe de Transformation de l'Aluminium Pechiney, Paris, France

[21] Appl. No.: 24,694

[22] Filed: Mar. 11, 1987

[30] Foreign Application Priority Data

Mar. 9, 1986 [FR] France ..... 86 04118

[51] Int. Cl.[4] ..... B22D 27/02

[52] U.S. Cl. ..... 164/502; 164/466; 164/418

[58] Field of Search ..... 164/502, 503, 147.1, 164/466, 467, 418

[56] References Cited

U.S. PATENT DOCUMENTS 4,456,054 6/1984 Henders ..... 164/502 X 4,457,354 7/1984 Dantzig et al. ..... 164/504 X

*Primary Examiner*—Knuag Y. Lin

*Attorney, Agent, or Firm*—Dennison, Meserole, Pollack & Scheiner

[57] ABSTRACT

The invention relates to an apparatus for regulating the level of the line of contact of the free surface of the metal with the mould in vertical casting. It comprises a mould formed by a material having a level of resistivity of higher than 5 $\mu\omega$.cm, surrounded by an annular coil in which at least one alternating electrical current flows. It finds application in the casting of metallurgical semi-manufactured products, in particular of aluminium and alloys thereof, such as for example lithium-bearing alloys, and in which there is a wish to have both a cortical zone of virtually zero thickness, a fine grain without the previous addition of refining agents, and an absence of pitting.

11 Claims, 2 Drawing Figures

APPARATUS FOR REGULATING THE LEVEL OF THE LINE OF CONTACT OF THE FREE SURFACE OF THE METAL WITH THE INGOT MOULD IN A VERTICAL CASTING OPERATION

The invention concerns an apparatus for regulating the level of the line of contact of the free surface of the metal with the ingot mould in a vertical casting operation.

When producing metallurgical semi-products by casting light or ferrous metals such as aluminium and alloys thereof, the man skilled in the art seeks to produce ingots, billets, plates, etc., which have the best possible degree of physical and chemical homogeneity, in order to avoid the appearance of certain defects when those products are subsequently worked to produce sheets, wires, etc.

Now, most of the casting processes which are used in industry at the present time give rise, when the metal goes from the liquid state to the solid state, to the formation of homogeneity faults of greater or lesser magnitude, which are essentially due to cooling conditions differing from one point of the cast products to another. Thus, in the casting process which involves casting the metal in a mould with a vertical passage, wherein the metal is successively cooled indirectly by way of the mould and then directly by means of a sheet of water, an external layer referred to as the "primary control layer" is found to be present on the semi-products. The structure and the composition of that layer differ from those of the internal part of the semi-product, the layer resulting from indirect cooling of the metal in contact with the mould. Moreover, other heterogeneity phenomena which are much less pronounced but which are all as troublesome may appear, such as "pocks" or small pits which are due in particular to dispersion in the metal material of the layer of oxide which is formed at the surface of the liquid metal which is in contact with the atmosphere.

It is true to say that the man skilled in the art has not remained inactive when faced with those problems and he has put forward a certain number of solutions which are more or less satisfactory, aiming to eliminate or at least reduce the seriousness of such heterogeneity.

Thus, in French Pat. No. 1 509 962, the man skilled in the art has recommended using electromagnetic casting, being a procedure in which, by virtue of the metal being confined by means of forces of electromagnetic origin, it is possible to eliminate the mould and thus to avoid the occurrence of the cortical layer since there is no longer any indirect cooling effect.

It is thus possible to arrive at an improvement in the homogeneity of the semi-manufactured products.

However, that procedure suffers from the following disadvantages:

it is necessary to equip the casting plant with an electrical installation which is relatively complicated and expensive because of the need to provide currents at non-industrial frequency (500 to 4000 Hz), of high strength (of the order of 5000 Å) in order to generate a suitable confining field, the risk of heterogeneity due to the formation of pitting is increased on the one hand due to the absence of a mould and therefore an increase in the surface area of liquid metal which is capable of suffering from oxidation, and on the other hand due to the phenomenon of stirring of the liquid mass caused by the confining field which contributes greatly to dislocation of the film of oxide and the dispersion thereof in the metal, it is often difficult to generate a suitable confinement effect when starting up the electromagnetic casting operation, and the safety of the personnel may be put at risk when casting aluminium and alloys thereof as, in the event of an electrical failure, the liquid metal which is no longer confined spreads to the outside of the mould and can come into contact with the fluid for producing the direct cooling effect, thereby causing an explosion.

Other, simpler solutions have also been proposed for reducing the thickness of the cortical layer. For example, French Pat. No. 1 398 526 teaches the use of a strip of fiberfrax which is glued to the mould so as to reduce the height of the metal in contact with the mould and therefore to reduce the effects due to indirect cooling. However, that reduction in height cannot be fixed once and for all as it depends in particular on the speed of casting. Thus, when that parameter varies, it is necessary either to change the mould or at least to alter the height of the strip. That gives rise to a lack of flexibility in a solution which ultimately provides only for partial suppression of the heterogeneity phenomena.

French Pat. No. 1 496 241 provides for eliminating the disadvantages of indirect cooling by using a non-cooled graphite mould, but that system then encounters problems in regard to frequent maintenance and changing of the mould due to the fragility of that material.

Another solution involves using moulds with a grooved or corrugated inside surface, by means of which the thickness of the cortical layer is reduced by more than 30% when casting for example aluminium 1050. However, besides the machining of those moulds which substantially increases the cost thereof, that system also suffers from the disadvantages involved in adapting the mould and in this case the grooves or corrugations to each casting speed.

Another known process is casting under load with a raised reservoir, referred to as "HOT TOP" casting, but that procedure also suffers from the disadvantage of resulting in periodic solidification of the meniscus, which is the cause of small ripples at the surface of the semi-manufactured products, as well as involving difficulties when starting up the casting procedure.

Finally, more recently, French Pat. No. 2 417 357 claimed a process wherein the axial length of the portion of the mould in contact with the liquid metal is varied by using a sleeve which slides on the inside wall of the mould. Such a system has the disadvantage, in the event of the metal solidifying in an untimely fashion, that it gives rise to an adhesion effect between the mould and the sleeve, thus causing tearing damage to those components at the time when the sliding movement is produced.

It is for that reason that the present applicants, being aware of the problems raised by those procedures, in order to produce homogeneous semi-manufactured products in which the thickness of the cortical layer is virtually zero, the material is of refined grain and the skin is free from pitting, sought and developed a process which has the following advantages over the prior-art processes:

the use of electrical installations which are less complicated than those which are required by the conventional electromagnetic casting process, easy transfer from the phase of starting up the casting operation to the steady-state phase of casting, easy adaptation to variations in parameters such as the speed of casting since the process does not require any modification in the equipment such as a change of mould, application to any type of conventional ingot mould, the absence of any apparatus which involves moving components, the risks of explosion due to leakage of the liquid metal are less serious than with conventional electromagnetic casting.

In order to arrive at that result, the applicants based themselves on the following observations:

on the one hand, the operation of starting off casting is easier in proportion to the level of metal in the mould being higher. Indeed, with a low level, the glass cloth filter which regularizes the feed of metal to the mould approaches the leading edge of solidification of the metal, and gives rise to the risk, when dealing with semi-manufactured products of small dimensions, of being clogged by untimely solidification of the metal and no longer being able to perform its proper function. Likewise, the phenomenon of cambering which occurs with semi-manufactured products of substantial width also prevents the casting operation from being started up at a low level of metal, and on the other hand, in the steady-state phase, it is preferable to cast with a height of metal in the mould which is as low as possible as that limits the height of the contact between the metal and the wall of the mould and accordingly reduces the thickness of the cortical zone which, as has been pointed out hereinbefore, is essentially due to cooling of the metal by way of the mould.

Therefore, starting from a conventional ingot mould with the contingencies thereof, that is to say while retaining a sufficient height of metal in the mould so as not to interfere with operation of the filter, it was therefore necessary to be able to limit as far as possible the height of the contact between the metal and the surface of the mould, which in brief amounted to finding a way of regulating the level of the line of contact of the free surface of the liquid metal with the wall of the mould.

That way comprises applying to the liquid in the course of solidification, a periodic magnetic field of variable intensity and with a direction substantially parallel to the axis of the mould, and adapting the intensity thereof in dependence on the desired level.

It has been found in fact that, by placing around the mould at least one circular coil constituted by an electrical circuit formed by one or more windings, and by feeding it with an alternating current at adequate industrial voltage, it was possible to modify the profile of the metal meniscus and in particular to vary the level of the above-mentioned line of contact of the metal with the mould, in direct relationship to the variations in the feed voltage and correlatively the intensity of the field generated.

Thus, by increasing the strength or intensity of the field, it was possible to lower the level and consequently reduce the height of the zone of metal contact or, on the other hand, by reducing the strength or intensity of the field, it was possible to raise the above-mentioned level and consequently increase the above-mentioned height.

The attraction of such a process is therefore that it makes it possible as desired to reduce the height of metal-mould contact and consequently the thickness of the cortical layer in a simple manner with a coil which is supplied with a current at an industrial frequency of 50 to 60 Hz, with the knowledge that the only repercussion of any electrical failure will be to vary the height of metal in the mould, that is to say any risk of liquid metal leakage will be avoided, which is not the case with electromagnetic casting.

Moreover, while the presence of a mould limits the possibility of oxidation of the liquid metal at the level of the meniscus, the mould, by virtue of its contact with the metal, prevents any displacement of the film of oxide towards the side wall and therefore any danger of pitting at the surface of the semi-manufactured product.

Moreover, the field applied to the metal also has the effect of generating forces within the liquid which homogenize the cooling effect and tend to cause a refining action in respect of the cast grain.

The coil which generates the magnetic field is preferably of a similar shape to that of the mould so that it creates a field which is in a direction substantially parallel to the axis of the mould. It is disposed along that axis in such a way that the zone where the field exerts its maximum action is between the apex of the liquid meniscus and the point of contact with the mould.

In a casting operation, such a process makes it possible to provide for normal start-up under the best possible conditions, that is to say with a great height of metal in the mould. For that purpose, the procedure involves using a field of low and possibly zero intensity or strength so as to minimize any modification in the normal level of the metal. Subsequently, in order to go into the steady-state phase, the strength of the field is increased until a minimum height is reached, resulting in a minimum thickness of the cortical layer. The maximum admissible value of the field is easily detected by the occurrence of deformation of the surface of the cast product, when that maximum admissible value is exceeded.

It is therefore only necessary to determine that value in the course of starting up a test casting and to apply it subsequently for all casting operations of the same type.

The above-indicated value generally corresponds to the time at which the level attained by the line of contact corresponds to the level at which the line of intersection between the leading edge of solidification of the metal due to indirect cooling and the leading edge of solidification of the metal due to direct cooling in the conventional casting mode occurs. The height of contact is then practically reduced to a circular line with the cortical layer being non-existent.

Depending on the type of alloy being cast, it is known that it will be necessary to effect casting at different speeds. The process makes it possible to modify the strength or intensity of the field in order to adapt it to the variations in speed and to determine, as before, the maximum admissible value of the strength of field for each of those speeds of casting.

Figure 1:
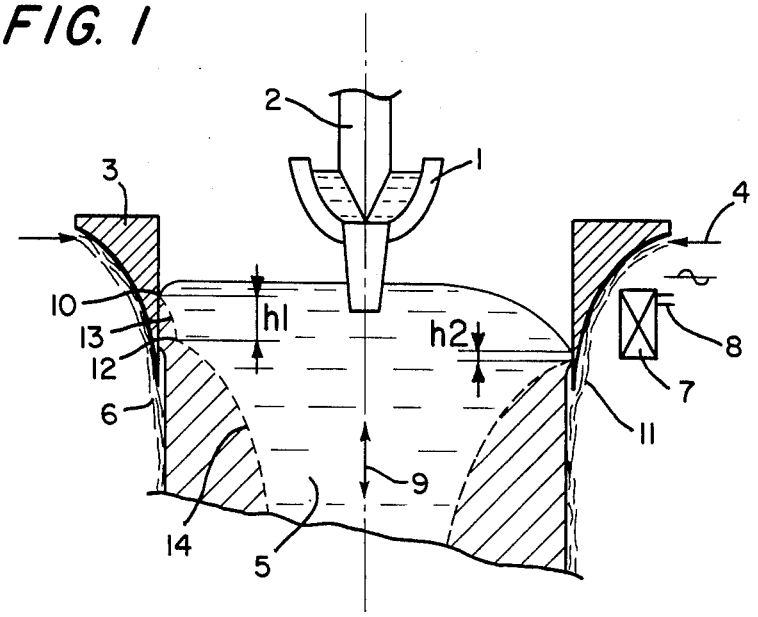
FIG. 1 is a view in vertical section of two mould halves, the mould half on the left being used in accordance with the prior art while that on the right is being used in accordance with the process of the present invention.

Shown in the drawing is a liquid metal feed nozzle 1, a level regulating stopper rod 2, an ingot mould 3 which is cooled directly by a fluid 4 which then cools the metal 5 directly at the point 6. The right-hand mould half is equipped with a coil 7 which is supplied with an a.c. voltage 8 in order to generate the magnetic field with a direction as indicated at 9 and to cause a lowering of the level of the line of contact of the surface of the metal with the mould from a point 10 in the prior-art casting operation to the point 11 in accordance with the process, which point is located at the level of the intersection 12 of the leading edge of solidification 13 of the metal resulting from indirect cooling and the leading edge 14 resulting from direct cooling. It will be seen therefore that the height of the contact of the metal with the mould has been reduced from a height $h_1$ to a height $h_2$ which is extremely small and which can be assimilated to the point 11.

The process can be illustrated by means of the following examples of use thereof:

Using an aluminium ingot mould measuring 320 mm in diameter and 100 mm in height, an aluminium alloy of type 2214 in accordance with the standards of the Aluminium Association was cast at a speed of 60 mm/minute. The stopper rod regulated the level of metal at the mid-height position of the mould and the cooling fluid came into contact with the skin of the cast billet at approximately 1 cm below the base of the mould.

In a first test, casting was carried out under the conditions of the prior art and micrographic examination of different sections of the billet showed that the cortical layer was of a mean thickness of 18 mm.

A series of tests were then carried out, in the course of which the mould was surrounded by an annular coil of an inside diameter of 372 mm, an outside diameter of 465 mm and a height of 48 mm, being formed by 120 turns of tin-plated copper wire of a diameter of 3.35 mm and fed with an alternating current at 50 Hz.

Each of the tests was performed under a different electrical voltage and measurements were made in respect of the corresponding mean cortical thicknesses as well as the size of the grains using the intersections method.

The results are set forth in the following Table:

| Voltage in volts | 0 | 50 | 100 | 150 | 180 |
|---|---|---|---|---|---|
| Cortical thickness in mm | 18 | 16 | 13 | 9 | 0 |
| Size of the grains in μm | 500 | | | 300 | 180 |

It is found therefore that the application of the process results in a progressive reduction in the thickness of the cortical layer in proportion to an increasing electrical voltage at the terminals of the coil, in proportions such that the cortical thickness becomes zero at a voltage of 180 volts.

At the same time, the grain size decreases in such a way that, starting from a metal which has grains of 500 μm in conventional casting, the process of the invention results in grains measuring 180 μm on average.

Moreover, no pitting is observed.

However, in the course of their tests, the applicants found that the conventional apparatuses used, whether for casting plates or for casting billets, were not the most suited to that regulating process. Thus, the applicants found that, while maintaining the results obtained in regard to the cortical layers and the size of the grains, it was possible to reduce the voltage necessary for the regulating effect, that is to say the level of electrical power consumed, by increasing the electrical resistance of the items of equipment which are disposed in the vicinity of the coil and in particular that of the mould itself. That increase can be achieved by modifying the composition of the material constituting those items of equipment in order to impart a higher level of resistance thereto, that is to say the structure of the items of equipment, in order to increase their resistance.

According to the invention, two paths were followed, one being characterised by using a mould formed by a solid material having a level of resistivity of higher than 5 μΩ.cm, while the other is characterised by using a mould which is divided in the direction of its height into at least two sectors which are separated from each other by an electrical insulation. In the first case, if an increase in the level of resistivity, for example in respect of the water boxes, is easy to achieve by using materials such as stainless steels or fibre-reinforced resins, on the other hand, in regard to the ingot moulds, the solution is found to be a less practical proposition by virtue of the conventional use of aluminium or copper, being metals which have a very low level of resistivity (<3 μΩ.cm).

During the tests, the applicants found that it was possible to reduce the electrical voltage necessary for the regulation effect, while maintaining suitable casting conditions, by using materials which belong to the group formed by ceramics, metals such as for example non-magnetic stainless steels and titanium. However, the best solution involves using aluminium alloys with elements such as manganese, chromium, titanium and vanadium which, at levels of concentration which are not excessively high, make it possible to arrive at relatively substantial proportions in solid solution and consequently higher levels of resistivity.

Thus, from the alloys involved, mention may be made of that which contains by weight approximately 1.8% Mn, 0.25% Cr, 0.2% Ti and 0.1% V and whose resistivity is equal to 9.3 μΩ.cm. However that level of resistivity may be improved by adding Mg up to a value of 5%, at which values of 11 to 12 μΩ.cm may be obtained. The addition of Li of up to 1% or Zr of up to 0.15% is also advantageous.

Other solutions involve using moulds formed by composite materials such as for example a stainless steel which is internally coated with a thin layer of aluminium.

In the second case, to reduce the electrical voltage required for the regulating action, the system uses a mould of a structure such that it makes it possible to increase the electrical resistance. That structure may be achieved by dividing the mould into sectors which are separated from each other by an electrical insulation and which are fitted together by means known to the man skilled in the art.

Figure 2:
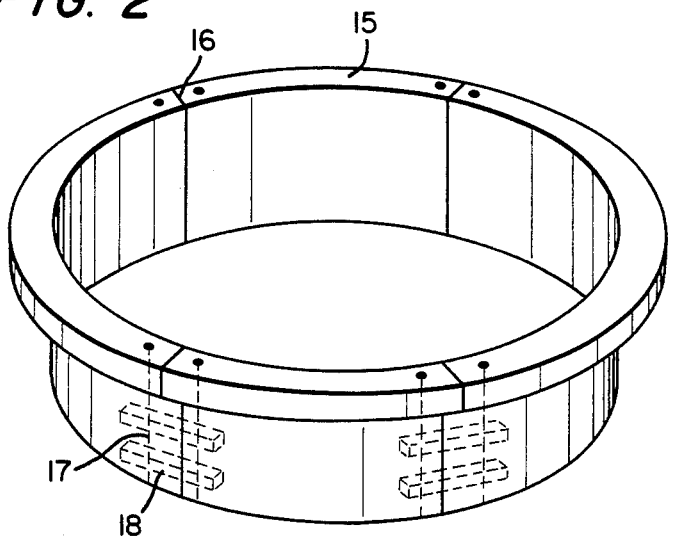
FIG. 2 is a perspective view of a mould constructed in accordance with the invention wherein the mould is divided into sectors which are separated from each other by electrical insulation.

FIG. 2 is a perspective view of such a mould which measures 320 mm in diameter and 120 mm in height, in which it can be seen there are four sectors which are separated over the entire height by a sheet of mica (16). The portions are held together by means of stainless steel pins 17 which pass through the rim of the mould and pegs 18 of insulating material, all said means being disposed in the mass of the mould. In order to arrive at a suitable result, it was found however that it was necessary to provide sectors which are not of excessively large width. Thus, widths of between 10 and 30 cm gave the best results.

When the moulds designed in accordance with the invention are subjected to the action of a magnetic field generated by an industrial current at a frequency of 50 to 60 Hz, they have the result of producing cast products which have both a cortical layer of very small or zero thickness and a fine grain size.

However the applicants found that operation thereof could be optimized by subjecting them to the action of a plurality of magnetic fields at different frequencies, which are capable of exacerbating separately each of the two results sought. It is necessary to be aware in fact that a field at high frequency produces its influence close to the surface of the cast product whereas a field at low frequency can extend its influence to the centre of the cast product. Consequently, provided that it passes through the mould, a field at a high frequency $N_1$ will be suitable to produce a zero cortical thickness. In contrast, in order to provide for a grain refining effect which therefore involves the entire section of the product, it will be necessary to use a lower frequency $N_2$ which is suited to the section of the product.

Preferably $N_1$ is selected from frequencies between 50 Hz and 1 kHz depending on the nature and the geometry of the mould and $N_2$ is at a minimum of the order of a Hz for cast products of substantial thickness (of the order of 60 cm in thickness).

The simultaneous application of those two frequencies $N_1$ and $N_2$ therefore makes it possible to produce the best effect at the same time on the two results sought. It should be noted that, if the electrical installation permitting the two currents at frequencies $N_1$ and $N_2$ to circulate in a single turn appears to be excessively complicated, it is possible to use two concentric turns, the turn through which the current at a frequency $N_2$ flows surrounding the turn through which the current of a frequency $N_1$ flows.

It will be noted that the application of those intense fields can result in a levitation effect in respect of moulds of aluminium alloys. That phenomenon can be avoided by firmly fixing the mould to the casting apparatus structure or by replacing the upper portion thereof by a piece of stainless steel. It will be appreciated that it is possible to combine the two solutions.

The invention can be illustrated by means of the following example of use:

The example uses moulds measuring 1100×300 mm and 120 mm in height, with different levels of resistivity. The moulds were surrounded by a winding formed, for reasons of electrical safety, by a single turn, through which passes a current at a frequency of 50 Hz. We measured the voltage necessary at the terminals of the winding to produce in all cases the same regulation in respect of the height of the line of contact between the liquid metal and the mould, that results in a zero thickness of cortical layer. The results are as follows:

| Resistivity (uΩ.cm) | 2.8 | 4 | 8 | 11 | 72 |
|---|---|---|---|---|---|
| Voltage (volts) | 6.3 | 5.7 | 4.0 | 3.9 | 3.2 |

It will be seen that the electrical voltage at the terminals of the winding and consequently the power consumed are greatly reduced by using moulds of higher resistivity. However, the gain achieved is relatively low for the very high levels of resistivity.

The present invention finds application in the casting of metallurgical semi-manufactured products, in particular of aluminium and alloys thereof, such as for example lithium-bearing alloys, and in which there is a wish to have both a cortical zone of virtually zero thickness, a fine grain without the previous addition of refining agents such as AT5B, and an absence of pitting.

What is claimed is:

1. Apparatus for regulating the level of the line of contact of the free surface of the metal with the mould (3) in a vertical casting operation by means of at least one annular coil (8) through which passes an alternating electrical current, surrounding said mould, characterised in that, in order to reduce the electrical voltage necessary for the regulation effect, a mould is used which consists of a solid material having a level of resistivity of higher than 5 μΩ.cm.

2. Apparatus for regulating the level of the line of contact of the free surface of the metal with the mould in a vertical casting operation by means of an annular coil through which passes an alternating electrical current, surrounding the mould, characterised in that, in order to reduce the electrical voltage necessary for the regulation effect, a mould is used which is divided in the direction of its height into at least two sectors which are separated from each other by an electrical insulation.

3. Apparatus according to claim 1 characterised in that the material is selected from the group consisting of ceramics, and metals and alloys with a high level of resistivity.

4. Apparatus according to claim 1 characterised in that the material is an aluminium alloy with a high level of resistivity.

5. Apparatus according to claim 4 characterised in that the material is an aluminium alloy of the following composition by weight: 1.8% Mn; 0.25% Cr; 0.2% Ti; 0.1% V; 5% Mg; and balance Al.

6. Apparatus according to claim 1 characterised in that the material is a composite product.

7. Apparatus according to claim 6 characterised in that the material is a non-magnetic stainless steel internally coated with a thin layer of aluminium.

8. Apparatus according to claim 2 characterised in that the sectors are between 10 and 30 cm in width.

9. Apparatus according to claim 1 or 2 characterised in that the annular coil is simultaneously connected to two sources of electrical current at different frequencies N1 and N2.

10. Apparatus according to claim 9 characterised in that one of the sources is at an industrial frequency N1 and the other is at a lower frequency N2.

11. Apparatus according to claim 1 or 2 characterised in that it comprises two annular coils, one of which is fed by a source at industrial frequency N1 and the other by a source at a lower frequency N2.

* * * * *